US007938198B2

(12) United States Patent
He

(10) Patent No.: US 7,938,198 B2
(45) Date of Patent: May 10, 2011

(54) ROTARY DIGGING AND COMPRESSION ENLARGING DRILLER AND BORING METHOD

(76) Inventor: Dexin He, Beijing (CN)

( * ) Notice: Subject to any disclaimer, the term of this patent is extended or adjusted under 35 U.S.C. 154(b) by 134 days.

(21) Appl. No.: 12/446,102

(22) PCT Filed: Mar. 1, 2007

(86) PCT No.: PCT/CN2007/000647
§ 371 (c)(1),
(2), (4) Date: Apr. 17, 2009

(87) PCT Pub. No.: WO2008/049292
PCT Pub. Date: May 2, 2008

(65) Prior Publication Data

US 2010/0300757 A1 Dec. 2, 2010

(30) Foreign Application Priority Data

Oct. 25, 2006 (CN) ..... 2006 1 0150039

(51) Int. Cl.
*E21B 10/26* (2006.01)
*E21B 7/00* (2006.01)

(52) U.S. Cl. ..... 175/57; 175/162; 175/203

(58) Field of Classification Search ..... 175/57, 175/162, 203, 273, 292; 173/151
See application file for complete search history.

(56) References Cited

U.S. PATENT DOCUMENTS 2,631,013 A * 3/1953 Darin ..... 175/173
3,039,547 A * 6/1962 Glover ..... 175/251

FOREIGN PATENT DOCUMENTS

| | | | |
|---|---|---|---|
| CN | 2458344 | Y | 11/2001 |
| CN | 2526490 | Y | 12/2002 |
| CN | 2698954 | Y | 5/2005 |
| CN | 2718062 | Y | 8/2005 |
| CN | 2767507 | Y | 3/2006 |
| JP | 8-303169 | A | 11/1996 |

OTHER PUBLICATIONS

International Search Report from PCT/CN2007/000647 dated Jul. 19, 2007 (2 pages).
Written Opinion from PCT/CN2007/000647 dated Jul. 19, 2007 (3 pages).

* cited by examiner

*Primary Examiner* — William P Neuder
(74) *Attorney, Agent, or Firm* — Osha • Liang LLP

(57) ABSTRACT

A compression enlarging driller comprises a vehicle body; a pole; an outer drilling rod; an inner drilling rod disposed within the outer drilling rod and moveable in a longitudinal direction; a windlass; a connecting lever having an upper end connected with a lower end of the inner drilling rod; a rotary digging bucket connected with a lower end of the connecting lever; a rotary enlarging device; a driving device; and a first hydraulic cylinder. When the driller bores a hoe, it can bore and enlarge the hole without changing a drill bit. A pile constructed by the driller has a high bearing capacity, the number of required piles is decreased, costs lower, and efficiency is improved.

15 Claims, 2 Drawing Sheets

ROTARY DIGGING AND COMPRESSION ENLARGING DRILLER AND BORING METHOD

BACKGROUND OF THE INVENTION

1. Field of the Invention

The present invention relates to a construction machine, and, in particular, relates to a rotary digging and compression enlarging driller with a function of boring and enlarging a hole. The driller is capable of boring a straight hole by boring and capable of forming an enlarged portion in the straight hole by rotary compression enlarging. The present invention further relates to a boring method using the driller.

2. Description of the Related Art

There are various drillers for boring pile shafts in foundations. Most conventional drillers can bore only straight holes. A rotary digging driller is proposed in recent years. An enlarging tool for enlarging a bottom of a pile shaft may be provided at an end of a drilling rod of the driller, but the enlarging tool can enlarge only a bottom of a bored straight hole. Furthermore, during enlarging the bottom of the bored straight hole, it is necessary to remove a boring tool from the drilling rod and to attach the enlarging tool to the drilling rod. In addition, the enlarging tool enlarges the bottom of the bored straight hole by cutting.

Currently, a widely applicable technique is proposed in which a multi-node pile can be constructed by compression enlarging of a pile shaft and poring concrete into the pile shaft with enlarged portions. Specifically, enlarged portions are formed at a plurality of predetermined positions in a bored straight pile shaft so that a pile can be formed to have a plurality of enlarged portions by filling the shaft with concrete. The technique can greatly improve the bearing capacity of a single pile, and decrease the number of required piles, the amount of required concrete, and the cost.

A prior process for constructing a pile by the above technique is carried out in the following manner. First of all, a straight hole is bored by a driller, and a plurality of enlarged portions are formed at a plurality of predetermined positions in the straight hole by a separate special compression enlarging apparatus. Then, the straight hole is cleaned and the diameter of the straight hole is detected. A reinforcing steel bar cage is placed into the straight hole. Finally, concrete is poured into the straight hole The above conventional construction process can improve the bearing capacity of a single pile, but has the following disadvantages. The number of steps of construction process, the cost and time for constructing a single pile increase. Since a compression enlarging is carried out by compression enlarging, rotating through an angle, and compression enlarging again in sequence, soil around the enlarged portion is disturbed when the enlarged portion is formed in the straight hole, so that spoil tends to drop on a bottom of the shaft and enlarged portion is not regular. If an enlarged portion is formed in a straight hole by cutting soil mass surrounding the shaft with a separate rotary digging and compression enlarging driller provided with a bottom-enlarging tool at an end of a drilling rod thereof, one enlarged portion can only be formed at the bottom of the straight hole. As a result, during forming the enlarged portion by cutting the surrounding soil mass, the soil body surrounding the cut soil mass is perturbed, but is not packed. Therefore, a side frictional resistance and an end resistance applied to the pile in the straight hole can not act on the pile together, so that the pile can not bear a high load.

SUMMARY OF THE INVENTION

An object of the present invention is to provide a rotary digging and compression enlarging driller with a function of boring and enlarging a hole, and a boring method using the driller. With the driller and the method according to the present invention, during boring, soil mass can be laterally rolled and pressed at any depth at any time to form an enlarged portion in a bored straight hole.

In accordance with a first aspect of the present invention, there is provided a rotary digging and compression enlarging driller. The driller comprises: a vehicle body; a pole adapted to be substantially vertically connected with the vehicle body; an outer drilling rod rotatably mounted to the pole in a longitudinal direction of the pole and movable in the longitudinal direction with respect to the pole; an inner drilling rod disposed within the outer drilling rod and moveable in the longitudinal direction with respect to the outer drilling rod; a windlass disposed in the vehicle body and connected with the inner drilling rod through a cable for raising, lowering, and hanging the inner drilling rod; a connecting lever having an upper end connected with a lower end of the inner drilling rod; a rotary digging bucket connected with a lower end of the connecting lever for boring; a rotary enlarging device for enlarging a hole, the rotary enlarging device having an end connected with the outer drilling rod and another end connected to the connecting lever adjacent to the lower end of the connecting lever so that the rotary enlarging device can protrude and retract by moving the inner drilling rod in the longitudinal direction with respect to the outer drilling rod; a driving device movable in the longitudinal direction with respect to the pole for driving the outer drilling rod to rotate, thereby driving the rotary enlarging device, the connecting lever, the rotary digging bucket, and the inner drilling rod to rotate; and a first hydraulic cylinder having an end connected with the outer drilling rod and another end connected with the inner drilling rod for driving the inner drilling rod to move in the longitudinal direction with respect to the outer drilling rod, thereby protruding and retracting the rotary enlarging device.

Preferably, the driller further comprises a second hydraulic cylinder having an end mounted to the pole and another end connected to the driving device for moving the driving device in the longitudinal direction, thereby moving the outer drilling rod, the rotary enlarging device, the connecting lever, the rotary digging bucket, and the inner drilling rod.

Preferably, the rotary enlarging device includes: an upper connecting disk connected to the lower end of the outer drilling rod; a lower connecting disk connected to the connecting lever adjacent to the lower end of the connecting lever; an upper rotary enlarging arm having an upper end pivotably connected to the upper connecting disk; a lower rotary enlarging arm having a lower end pivotably connected to the lower connecting disk, an upper end of the lower rotary enlarging arm being pivotably connected to a lower end of the upper rotary enlarging arm; and rolling cutters connected with the upper rotary enlarging arm and the lower rotary enlarging arm, respectively.

Furthermore, the rotary enlarging device comprises the three upper rotary enlarging arms and the corresponding three lower rotary enlarging arms.

Specifically, the rotary digging bucket is connected with the lower end of the connecting lever through a pin, the upper connecting disk is connected with the outer drilling rod through a pin, the lower connecting disk is connected with the connecting lever through a pin, each of the upper rotary enlarging arms is connected with the upper connecting disk through a pin, and each of the lower rotary enlarging arms is connected with the lower connecting disk through a pin.

Preferably, the outer drilling rod is rotatably mounted to the pole through a lower supporting sleeve, and the lower supporting sleeve is movable in the longitudinal direction with respect to the pole; the inner drilling rod is mounted to the pole through an upper supporting sleeve, and the upper supporting sleeve is movable in the longitudinal direction with respect to the pole; and the end of the first hydraulic cylinder is connected with the lower supporting sleeve and the other end of the first hydraulic cylinder is connected with the upper supporting sleeve.

Preferably, the driller further comprises a controlling device disposed in the vehicle body for controlling operation of the driller.

In accordance with another aspect of the present invention, there is provided a boring method using the driller according to the first aspect of the present invention. The method comprises the steps of: rotating the outer drilling rod, the rotary enlarging device, the connecting lever, the inner drilling rod, and the rotary digging bucket by means of the driving device to bore a hole; driving the inner drilling rod by means of the first hydraulic cylinder to move in the longitudinal direction with respect to the outer drilling rod, thereby protruding the rotary enlarging device to enlarge the hole so as to form an enlarged portion in the bored hole, when the hole is bored to a predetermined depth; and driving the inner drilling rod by means of the first hydraulic cylinder to move in the longitudinal direction with respect to the outer drilling rod, thereby retracting the rotary enlarging device so as to bore the hole.

Alternatively, the enlarging and boring are alternately performed predetermined times, so as to form a predetermined number of enlarged portions in the bored hole.

The driller according to the present invention can bore a straight hole and form enlarged portions in the bored straight hole. When an enlarged portion is formed, if general soil mass is met, the rotary enlarging arms are gradually protruded by the hydraulic system to roll the soil mass in a forward direction; and if hard soil mass is met, the driller can firstly rotate in a reverse direction to cut the soil mass with a side cutter. When a certain amount of soil is removed from the soil mass, the driller rotates in the forward direction so that the rotary enlarging arms roll the soil mass, thereby forming an enlarged portion by lateral rolling and compression enlarging.

The driller according to an embodiment of the present invention and the method using the driller eliminate the disadvantage of a conventional driller. A single driller can achieve the operations such as boring a hole, rotary compression enlarging, and cleaning the hole. All the processes can be mechanically completed once so that the construction time can be significantly decreased.

Since the enlarged portion is formed by rotary compression enlarging and rolling, the enlarged portion is complete so as to further improve the bearing capacity of a pile. The driller according to the present invention has a wider application area and a more reliable quality, and can further improve construction efficiency.

Since the enlarged portion is formed by rotary rolling and compression enlarging, and the compression is to compress side soil mass around a hole, a side frictional resistance and an end resistance applied to a constructed pile can act on the pile together, so that the bearing capacity of the pile can be further improved. Since the enlarged portion is formed by rotary compression enlarging and rolling, the enlarged portion is complete so that a better construction quality is ensured.

Furthermore, since the driller according to the present invention can perform both cutting, and rolling and compression enlarging, the range of soil mass to which it is applicable is wide. There is a considerable saving in manpower, material resources and a saving in costs and an improving in efficiency by using the driller.

DETAILED DESCRIPTION OF THE EMBODIMENTS

Figure 1:
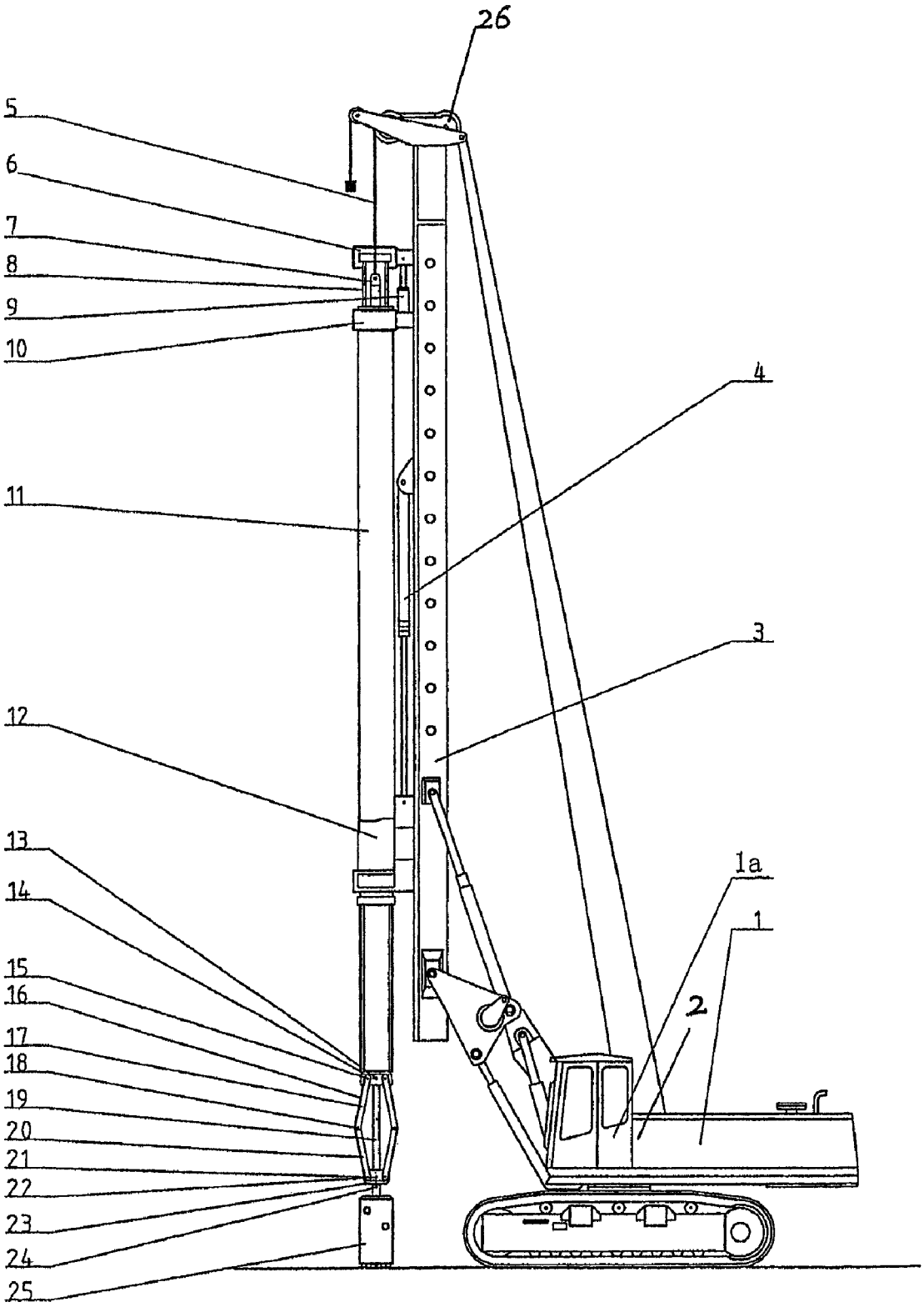
FIG. 1 is a schematic view showing a rotary digging and compression enlarging driller according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures. However, the present application is not limited to the embodiments.

Figure 2:
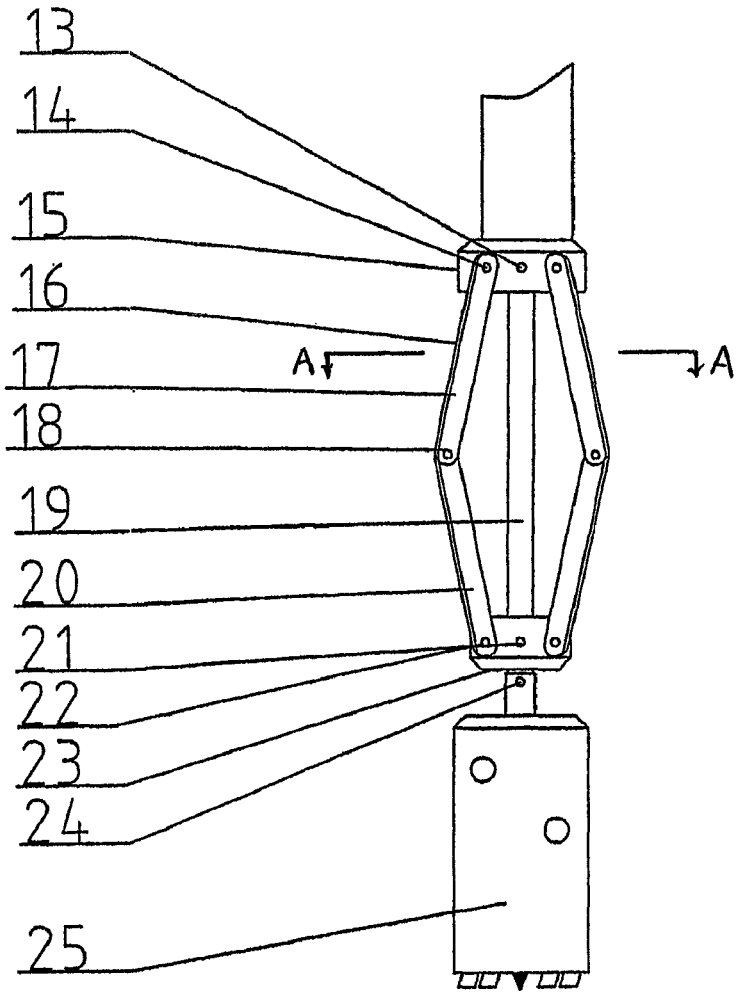
FIG. 2 is a schematic view showing rotary enlarging arms and a rotary digging bucket of the rotary digging and compression enlarging driller of FIG. 1.
Figure 3:
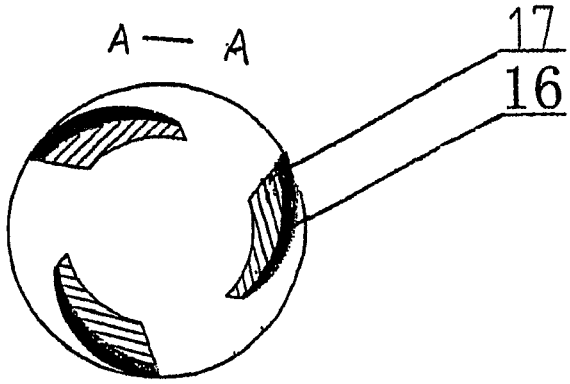
FIG. 3 is a section view taken along line A-A of FIG. 2 which shows rolling cutter mounted on the rotary enlarging arms.

FIG. 1 is a schematic view showing a rotary digging and compression enlarging driller according to an embodiment of the present invention, FIG. 2 is a schematic view showing rotary enlarging arms and a rotary digging bucket of the rotary digging and compression enlarging driller of FIG. 1, and FIG. 3 is a section view taken along line A-A of FIG. 2 which shows rolling cutter mounted on the rotary enlarging arms.

As shown in FIG. 1, a rotary digging and compression enlarging driller with a function of boring and enlarging a hole mainly comprises: a vehicle body 1, a pole 3, an outer drilling rod 11, an inner drilling rod 8, a windlass 2, a connecting lever 19, a rotary digging bucket 25, a rotary enlarging device, a driving device 12, a second hydraulic cylinder 4, and a first hydraulic cylinder 9.

The driller further comprises a controlling device 1*a* disposed at the vehicle body 1 for controlling all operations of the driller. For example, the controlling device 1*a* is used to control the driving device 12, the first hydraulic cylinder 9, the second hydraulic cylinder 4, and the windlass 2 to be actuated and stopped.

A person having ordinary skill in the art can obviously embody the controlling device 1*a* in many manners according to teaching of the prior art. Therefore, configuration of the controlling device 1*a* is not described in detail for the purpose of conciseness.

Specifically, the pole 3 is adapted to be substantially vertically connected with the vehicle body 1, for example by means of hydraulic cylinders. It will be appreciated that in use, the pole 3 is substantially vertically connected with the vehicle body 1, and when the driller does not operate, the pole 3 may be horizontally placed by the hydraulic cylinders to facilitate movement of the driller from a construction site to another construction site.

The outer drilling rod 11 is rotatably mounted to the pole 3 in a longitudinal direction of the pole 3. For example, an upper end of the outer drilling rod 11 is mounted to the pole 3 through a lower supporting sleeve 10. The lower supporting sleeve 10 can move upwards and downwards in the longitudinal direction of the pole 3. The outer drilling rod 11 can rotate with respect to the lower supporting sleeve 10.

An inner drilling rod 8 is disposed within the outer drilling rod 11 and can move upwards and downwards in the longitudinal direction with respect to the outer drilling rod 11. Furthermore, the inner drilling rod 8 is mounted to the pole 3 through an upper supporting sleeve 6, and the upper supporting sleeve 6 is fixed to the pole 3. The inner drilling rod 8 can rotate with respect to the upper supporting sleeve 6.

It will be appreciated that during boring, the outer drilling rod 11 drives the inner drilling rod 8 to rotate through the rotary enlarging device and the connecting lever 19, and at the same time the outer drilling rod 11 and the inner drilling rod 8 are driven to move downwards so as to bore a hole by means of the rotary digging bucket 25. In addition, since the outer drilling rod 11 and the inner drilling rod 8 are driven to move downwards together, when the first hydraulic cylinder 9 is not actuated, the inner drilling rod 8 does not move in the longitudinal direction with respect to the outer drilling rod 11 so that the rotary enlarging device remains in a retracted state.

The windlass 2 is disposed in the vehicle body 1 and is connected with an upper end of the inner drilling rod 8 through a cable 5 to raise, lower and hang the inner drilling rod 8. A pulley block 26 is disposed at a top of the pole 3. The cable 5 has an end connected to the windlass 2, and another end connected to the inner drilling rod 8 after the cable wraps around the pulley block 26.

The driving device 12 is used to drive the outer drilling rod 11 so as to drive the rotary enlarging device, the connecting lever 19, the rotary digging bucket 25, and the inner drilling rod 8 to rotate. For example, the driving device 12 may comprise a hydraulic motor, a speed reducer, a driving gear fitted over an output shaft of the speed reducer, and a driven gear meshing with the driving gear. The driven gear is fitted over the outer drilling rod 10, for example by means of spline, so as to drive the outer drilling rod 10 to rote. When the second hydraulic cylinder 4 is actuated, the driving device 12 moves downwards with respect to the pole 3. Since the driven gear is fitted over the outer drilling rod 10 by means of spline, the driven gear drives the outer drilling rod 10 to move downwards by friction between projections and slots of the spline. The driving device 12, however, is not limited to that described in this embodiment.

The rotary digging bucket 25 is connected to a lower end of the connecting lever 19 for boring. An upper end of the connecting lever 19 is connected with a lower end of the inner drilling rod 8. The rotary digging bucket 25 is connected with the connecting lever 19 by means of a pin 24. In this embodiment, the rotary digging bucket 25 is in a form of a cylinder; however, the form is not limited to this.

The second hydraulic cylinder 4 has a cylinder body connected to the pole 3 and a piston rod connected to the driving device 12 to move the outer drilling rod 11 in the longitudinal direction of the pole 3 so as to move the inner drilling rod 8 and the rotary digging bucket 25 through the rotary enlarging device and the connecting lever 19.

The rotary enlarging device is used to enlarge a hole. The rotary enlarging device has an end connected with the outer drilling rod 11 and another end connected with the connecting lever 19 adjacent to the lower end of the connecting lever 19, so that the rotary enlarging device protrudes and retracts when the inner drilling rod 8 moves in the longitudinal direction with respect to the outer drilling rod 11.

Specifically, referring to FIG. 2, the rotary enlarging device comprises: an upper connecting disk 15 connected to a lower end of the outer drilling rod 11 through a pin 13; a lower connecting disk 23 connected to the connecting lever 19 through a pin 22; three upper rotary enlarging arms 17 having upper ends pivotably connected to the upper connecting disk 15 through pins 14, respectively; three lower rotary enlarging arms 20 having lower ends pivotably connected to the lower connecting disk 23 through pins 21, respectively, upper ends of the lower rotary enlarging arms 20 being pivotably connected to lower ends of the upper rotary enlarging arms 17 through pins 18, respectively; and rolling cutters 16 connected to the upper rotary enlarging arms 17 and the lower rotary enlarging arms 20, respectively, as shown in FIG. 3.

Each of the numbers of the upper rotary enlarging arms 17 and the lower rotary enlarging arms 20 is not limited to three, and may be any appropriate number such as two, four, or six.

The first hydraulic cylinder 9 has a cylinder body connected to the outer drilling rod 11, and a piston rod connected to the inner drilling rod 8 to drive the inner drilling rod 8 to move in the longitudinal direction with respect to the outer drilling rod 11 so as to protrude (as shown in FIG. 2) and retract the upper rotary enlarging arms 17 and the lower rotary enlarging arms 20. Therefore, the first hydraulic cylinder is also called a compression enlarging hydraulic cylinder. More specifically, the cylinder body of the first hydraulic cylinder 9 is connected to the lower supporting sleeve 10 and the piston rod of the first hydraulic cylinder 9 is connected to the upper supporting sleeve 6.

The driller having the above configuration can bore and enlarge a hole. Therefore, it does not need a separate special hole-enlarging apparatus to form an enlarged portion in a bored straight hole, and it is not necessary to replace a rotary digging bucket with a special hole-enlarging device.

During boring a hole, the inner drilling rod 8 move upwards with respect to the outer drilling rod 11, so that the upper rotary enlarging arms 17 and the lower rotary enlarging arms 20 retract; the driving device 12 drives the outer drilling rod 11, so that the outer drilling rod 11 drives the connecting lever 19, the inner drilling rod 8 and the rotary digging bucket 25 to rotate together through the upper rotary enlarging arms 17 and the lower rotary enlarging arms 20, and at the same time the second hydraulic cylinder 4 is actuated to push the outer drilling rod 11, the upper rotary enlarging arms 17, the lower rotary enlarging arms 20, the connecting lever 19, the inner drilling rod 8, and the rotary digging bucket 25 downwards with respect to the pole 3 so as to bore a straight hole.

It will be appreciated that the second hydraulic cylinder 4 only auxiliary pushes the push the outer drilling rod 11, the upper rotary enlarging arms 17, the lower rotary enlarging arms 20, the connecting lever 19, the inner drilling rod 8, and the rotary digging bucket 25 downwards. The second hydraulic cylinder 4 is not necessary. During boring, the rotary digging bucket 25 may be pushed downwards by means of weight of the driller itself to bore a hole.

During enlarging a hole, the second hydraulic cylinder 4 stops, and the first hydraulic cylinder 9 is actuated to move the inner drilling rod 8 upwards with respect to the outer drilling rod 11. The upper connecting disk 15 and the lower connecting disk 25 approach each other so that the upper rotary enlarging arms 17 and the lower rotary enlarging arms 20 gradually protrude outwards. At the same time, the upper rotary enlarging arms 17 and the lower rotary enlarging arms 20 are driven, by the driving device 12 through the outer drilling rod 11, to rotate, so that the rolling cutters 16 connected to the upper rotary enlarging arms 17 and the lower rotary enlarging arms 20 roll and press and/or cut soil mass surrounding the hole. As a result, an enlarged portion is formed at a predetermined depth in the bored straight hole.

The terms "roll", "rolling", "rolled" mean that the rolling cutters 16 are brought into contact with soil mass at an obtuse angle to press the soil mass without cutting of the soil mass.

Referring to FIG. 3, when the rolling cutters 16 rotate clockwise, they roll soil mass. The rolling is particularly suitable for soft soil mass.

If soil mass is hard, firstly, the soil mass can be cut by the rolling cutter 16, and then the soil mass is rolled and pressed. Of course, the hard soil mass may be directly rolled and pressed without cutting of the soil mass. The terms "cut" and "cutting" mean that the rolling cutters 16 are brought into contact with soil mass at an acute angle. Referring to FIG. 3, when the rolling cutters 16 rotate counterclockwise, they cut soil mass, but do not roll the soil mass. Therefore, the driller according to the present invention is applicable to a wide range and may be used to bore and enlarge a hole in hard soil mass.

A boring method using the driller according to the present invention is now described.

Firstly, the first hydraulic cylinder 9 is actuated to move the inner drilling rod 8 downwards with respect to outer drilling rod 11 so that the upper rotary enlarging arms 17 and the lower rotary enlarging arms 20 sufficiently retract. Then, the first hydraulic cylinder 9 stops.

Next, the driving device 12 is actuated to drive the outer drilling rod 11, the upper rotary enlarging arms 17, the lower rotary enlarging arms 20, the connecting lever 19, the inner drilling rod 8 and the rotary digging bucket 25 to rotate together, and at the same time the second hydraulic cylinder 4 is actuated to push the upper rotary enlarging arms 17, the lower rotary enlarging arms 20, the connecting lever 19, the inner drilling rod 8, and the rotary digging bucket 25 downwards with respect to the pole 3 so as to bore a straight hole.

When an enlarged portion is to be formed at a determined depth in the straight hole, the second hydraulic cylinder 4 stops and the first hydraulic cylinder 9 is actuated again to move the inner drilling rod 8 upwards with respect to the outer drilling rod 11 so that the upper rotary enlarging arms 17 and the lower rotary enlarging arms 20 gradually protrude outwards, and at the same time the driving device 12 rotates the upper rotary enlarging arms 17 and the lower rotary enlarging arms 20, so that the rolling cutters 16 roll and press and/or cut soil mass surrounding the hole to form the enlarged portion.

After the enlarging process is completed, the first hydraulic cylinder 9 drives the inner drilling rod 8 to move downwards with respect to the outer drilling rod 11, so that the upper rotary enlarging arms 17 and the lower rotary enlarging arms 20 retract, for example the upper rotary enlarging arms 17 and the lower rotary enlarging arms 20 retract to be less than a diameter of the bore, in order to bore.

Enlarged portions can be formed at a plurality of depths in the bored hole by repeating the boring operation and the enlarging operation.

After the boring and enlarging are completed, the bored hole with the enlarged portions is cleaned. Then, a reinforcing steel bar cage is placed into the hole and concrete is poured into the hole to form a pile with a plurality of enlarged portions. Since the enlarged portions can be formed by rolling and pressing so that soil mass surrounding the hole is little affected, and the constructed pile has a plurality of enlarged portions, the constructed pile has an improved bearing capacity, amount of concrete for the pile can decrease, and the number of piles for a predetermined building can lower so as to reduce costs.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A rotary digging and compression enlarging driller, comprising:

a vehicle body;

a pole adapted to be substantially vertically connected with the vehicle body;

an outer drilling rod rotatably mounted to the pole in a longitudinal direction of the pole and movable in the longitudinal direction with respect to the pole;

an inner drilling rod disposed within the outer drilling rod and moveable in the longitudinal direction with respect to the outer drilling rod;

a windlass disposed in the vehicle body and connected with the inner drilling rod through a cable for raising, lowering, and hanging the inner drilling rod;

a connecting lever having an upper end connected with a lower end of the inner drilling rod;

a rotary digging bucket connected with a lower end of the connecting lever for boring;

a rotary enlarging device for enlarging a hole having an end connected with the outer drilling rod and another end connected to the connecting lever adjacent to the lower end of the connecting lever, the rotary enlarging device being capable of protruding and retracting by moving the inner drilling rod in the longitudinal direction with respect to the outer drilling rod;

a driving device movable in the longitudinal direction with respect to the pole for driving the outer drilling rod to rotate, thereby driving the rotary enlarging device, the connecting lever, the rotary digging bucket, and the inner drilling rod to rotate; and a first hydraulic cylinder having an end connected with the outer drilling rod and another end connected with the inner drilling rod for driving the inner drilling rod to move in the longitudinal direction with respect to the outer drilling rod, thereby protruding and retracting the rotary enlarging device.

2. The rotary digging and compression enlarging driller according to claim 1, further comprising a second hydraulic cylinder having an end mounted to the pole and another end connected to the driving device for moving the driving device in the longitudinal direction, thereby moving the outer drilling rod, the rotary enlarging device, the connecting lever, the rotary digging bucket, and the inner drilling rod.

3. The rotary digging and compression enlarging driller according to claim 2, wherein the rotary enlarging device comprises:

an upper connecting disk connected to the lower end of the outer drilling rod;

a lower connecting disk connected to the connecting lever adjacent to the lower end of the connecting lever;

at least one upper rotary enlarging arm having an upper end pivotably connected to the upper connecting disk;

at least one lower rotary enlarging arm having a lower end pivotably connected to the lower connecting disk, an upper end of the at least one lower rotary enlarging arm being pivotably connected to a lower end of the at least one upper rotary enlarging arm; and rolling cutters connected with the at least one upper rotary enlarging arm and the at least one lower rotary enlarging arm, respectively.

4. The rotary digging and compression enlarging driller according to claim 3, wherein the rotary enlarging device comprises three upper rotary enlarging arms and three lower rotary enlarging arms.

5. The rotary digging and compression enlarging driller according to claim 4, wherein the rotary digging bucket is connected with the lower end of the connecting lever through a pin, the upper connecting disk is connected with the outer drilling rod through a pin, the lower connecting disk is connected with the connecting lever through a pin, each of the upper rotary enlarging arms is connected with the upper connecting disk through a pin, and each of the lower rotary enlarging arm is connected with the lower connecting disk through a pin.

6. The rotary digging and compression enlarging driller according to claim 5, wherein the outer drilling rod is rotatably mounted to the pole through a lower supporting sleeve, and the lower supporting sleeve is movable in the longitudinal direction with respect to the pole;

the inner drilling rod is mounted to the pole through an upper supporting sleeve, and the upper supporting sleeve is movable in the longitudinal direction with respect to the pole; and the end of the first hydraulic cylinder is connected with the upper supporting sleeve and the other end of the first hydraulic cylinder is connected with the lower supporting sleeve.

7. The rotary digging and compression enlarging driller according to claim 6, further comprising a controlling device disposed in the vehicle body for controlling operation of the driller.

8. A boring method using the rotary digging and compression enlarging driller according to claim 2, comprising the steps of:

rotating the outer drilling rod, the rotary enlarging device, the connecting lever, the inner drilling rod, and the rotary digging bucket by means of the driving device to bore a hole;

driving the inner drilling rod by means of the first hydraulic cylinder to move in the longitudinal direction with respect to the outer drilling rod, thereby protruding the rotary enlarging device to enlarge the hole so as to forming an enlarged portion in the bored hole, when the hole is bored to a predetermined depth; and driving the inner drilling rod by means of the first hydraulic cylinder to move in the longitudinal direction with respect to the outer drilling rod, thereby retracting the rotary enlarging device so as to bore the hole.

9. A boring method using the rotary digging and compression enlarging driller according to claim 3, comprising the steps of:

rotating the outer drilling rod, the rotary enlarging device, the connecting lever, the inner drilling rod, and the rotary digging bucket by means of the driving device to bore a hole;

driving the inner drilling rod by means of the first hydraulic cylinder to move in the longitudinal direction with respect to the outer drilling rod, thereby protruding the rotary enlarging device to enlarge the hole so as to forming an enlarged portion in the bored hole, when the hole is bored to a predetermined depth; and driving the inner drilling rod by means of the first hydraulic cylinder to move in the longitudinal direction with respect to the outer drilling rod, thereby retracting the rotary enlarging device so as to bore the hole.

10. A boring method using the rotary digging and compression enlarging driller according to claim 4, comprising the steps of:

rotating the outer drilling rod, the rotary enlarging device, the connecting lever, the inner drilling rod, and the rotary digging bucket by means of the driving device to bore a hole;

driving the inner drilling rod by means of the first hydraulic cylinder to move in the longitudinal direction with respect to the outer drilling rod, thereby protruding the rotary enlarging device to enlarge the hole so as to forming an enlarged portion in the bored hole, when the hole is bored to a predetermined depth; and driving the inner drilling rod by means of the first hydraulic cylinder to move in the longitudinal direction with respect to the outer drilling rod, thereby retracting the rotary enlarging device so as to bore the hole.

11. A boring method using the rotary digging and compression enlarging driller according to claim 5, comprising the steps of:

rotating the outer drilling rod, the rotary enlarging device, the connecting lever, the inner drilling rod, and the rotary digging bucket by means of the driving device to bore a hole;

driving the inner drilling rod by means of the first hydraulic cylinder to move in the longitudinal direction with respect to the outer drilling rod, thereby protruding the rotary enlarging device to enlarge the hole so as to forming an enlarged portion in the bored hole, when the hole is bored to a predetermined depth; and driving the inner drilling rod by means of the first hydraulic cylinder to move in the longitudinal direction with respect to the outer drilling rod, thereby retracting the rotary enlarging device so as to bore the hole.

12. A boring method using the rotary digging and compression enlarging driller according to claim 6, comprising the steps of:

rotating the outer drilling rod, the rotary enlarging device, the connecting lever, the inner drilling rod, and the rotary digging bucket by means of the driving device to bore a hole;

driving the inner drilling rod by means of the first hydraulic cylinder to move in the longitudinal direction with respect to the outer drilling rod, thereby protruding the rotary enlarging device to enlarge the hole so as to forming an enlarged portion in the bored hole, when the hole is bored to a predetermined depth; and driving the inner drilling rod by means of the first hydraulic cylinder to move in the longitudinal direction with respect to the outer drilling rod, thereby retracting the rotary enlarging device so as to bore the hole.

13. A boring method using the rotary digging and compression enlarging driller according to claim 7, comprising the steps of:

rotating the outer drilling rod, the rotary enlarging device, the connecting lever, the inner drilling rod, and the rotary digging bucket by means of the driving device to bore a hole;

driving the inner drilling rod by means of the first hydraulic cylinder to move in the longitudinal direction with respect to the outer drilling rod, thereby protruding the rotary enlarging device to enlarge the hole so as to forming an enlarged portion in the bored hole, when the hole is bored to a predetermined depth; and driving the inner drilling rod by means of the first hydraulic cylinder to move in the longitudinal direction with respect to the outer drilling rod, thereby retracting the rotary enlarging device so as to bore the hole.

14. A boring method using the rotary digging and compression enlarging driller according to claim 1, comprising:

step 1: rotating the outer drilling rod, the rotary enlarging device, the connecting lever, the inner drilling rod, and the rotary digging bucket by means of the driving device to bore a hole;

step 2: driving the inner drilling rod by means of the first hydraulic cylinder to move in the longitudinal direction with respect to the outer drilling rod, thereby protruding the rotary enlarging device to enlarge the hole so as to forming an enlarged portion in the bored hole, when the hole is bored to a predetermined depth; and step 3: driving the inner drilling rod by means of the first hydraulic cylinder to move in the longitudinal direction with respect to the outer drilling rod, thereby retracting the rotary enlarging device.

15. The boring method according to claim 14, wherein the step 1, the step 2, and the step 3 are performed for a predetermined number of times, so as to form a predetermined number of enlarged portions in the bored hole.

* * * * *